US006026730A

United States Patent [19]

Yoshida et al.

[11] Patent Number: 6,026,730

[45] Date of Patent: Feb. 22, 2000

[54] FLOW CONTROL APPARATUS IN A HYDRAULIC CIRCUIT

[75] Inventors: Nobumi Yoshida; Tadao Karakama; Nobuhisa Honda, all of Kanagawa-ken, Japan

[73] Assignee: Komatsu Ltd., Japan

[21] Appl. No.: 08/583,017

[22] PCT Filed: Aug. 12, 1994

[86] PCT No.: PCT/JP94/01346

§ 371 Date: Jan. 19, 1996

§ 102(e) Date: Jan. 19, 1996

[87] PCT Pub. No.: WO95/05545

PCT Pub. Date: Feb. 23, 1995

[30] Foreign Application Priority Data

Aug. 13, 1993 [JP] Japan ..... 5-201607
Aug. 13, 1993 [JP] Japan ..... 5-201613

[51] Int. Cl.[7] ..... F15B 11/08

[52] U.S. Cl. ..... 91/447; 91/448; 91/461; 91/519

[58] Field of Search ..... 91/446, 497, 498, 91/461, 519

[56] References Cited

U.S. PATENT DOCUMENTS

| | | | |
|---|---|---|---|
| 4,955,283 | 9/1990 | Hidaka et al. | 91/447 |
| 5,333,449 | 8/1994 | Takahashi et al. | 91/446 X |
| 5,347,811 | 9/1994 | Hasegawa et al. | 91/446 X |
| 5,409,038 | 4/1995 | Yoshida et al. | 91/446 X |
| 5,579,642 | 12/1996 | Wilke et al. | 91/446 X |

FOREIGN PATENT DOCUMENTS

| | | |
|---|---|---|
| 57-116967 | 7/1982 | Japan . |
| 58-218470 | 12/1983 | Japan . |
| 62-12658 | 1/1987 | Japan . |
| 4290603 | 10/1992 | Japan . |
| 4300404 | 10/1992 | Japan . |
| 2295859 | 6/1946 | United Kingdom . |

*Primary Examiner*—Hoang Nguyen
*Attorney, Agent, or Firm*—Rader, Fishman & Grauer; Ronald P. Kananen

[57] ABSTRACT

For supplying a large volumetric flow into a particular hydraulic actuator without requiring a directional control valve to be large-sized and without making large a pressure difference between a pump discharge pressure and a load pressure or reducing the pressure loss when a large volumetric flow is flushed out into a tank, a flow control apparatus in a hydraulic circuit is designed to supply a pressurized discharge fluid from the hydraulic pump (10) via a directional control valve (15) and a pressure compensation valve (18) to a plurality of hydraulic actuators (16) which are arranged in parallel to one another, the apparatus in its construction including an auxiliary control valve (30) for supplying the pressurized fluid to a particular one of the hydraulic actuators (16), which is supplied with the pressurized discharge fluid from the hydraulic pump (10) via the said auxiliary directional control valve (30) and the directional control valve (15), or whose return fluid out of that particular hydraulic actuator (16) is flushed into a tank via the auxiliary directional control valve (30) and the directional control valve (15).

16 Claims, 9 Drawing Sheets

PRIOR ART

FLOW CONTROL APPARATUS IN A HYDRAULIC CIRCUIT

TECHNICAL FIELD

The present invention relates to a flow control circuit for an operating fluid in a hydraulic circuit that includes a plurality of hydraulic actuators which are supplied with a pressurized discharge fluid from a single hydraulic pump. More particularly, this invention relates to a flow control apparatus for use in such a hydraulic circuit, in which a large volumetric flow is supplied into a particular one of the hydraulic actuators and/or is flushed out of a particular one of the hydraulic actuators into a tank.

BACKGROUND ART

In order for a plurality of hydraulic actuators to be supplied with a pressurized discharge fluid from a single hydraulic pump, a discharge path of the single hydraulic pump can be provided with a plurality of operating valves in parallel to one another so that by switching over the operating valves the respective hydraulic actuators may be supplied with the pressurized fluid. If such an arrangement is adopted, however, when a plurality of the hydraulic actuators should be supplied with the pressurized fluid at the same time, it will follow that the pressurized fluid may be supplied only to an actuator whose load is small and may not be supplied to an actuator whose load is large.

Designed to resolve this problem, there has hitherto been known a pressurized fluid supply apparatus as shown in FIG. 1.

Specifically, as shown in FIG. 1, the hydraulic pump 10 will, by changing the angle of inclination of a swash plate 11, be rendered a hydraulic pump of variable displacement type in which its displacement, that is, its discharging flow per one revolution, is varied, and in which the swash plate 11 is inclined by means of a large diameter piston 12 in a displacement decreasing direction and is inclined by means of a small diameter piston 13 in a displacement increasing direction.

The above mentioned large diameter piston 12 has a pressure receiving chamber 12*a* which in the sense of communication is connected to and disconnected from a discharge path 10*a* of the hydraulic pump 10 by way of a switching valve 14, whereas the above mentioned small diameter piston 13 has a pressure receiving chamber 13*a* which is connected to the above mentioned discharge path 10*a*.

The discharge path 10*a* of the above mentioned hydraulic pump 10 is provided with a plurality of directional control valves 15. In each circuit 17 for connecting each of the directional control valves 15 to each hydraulic actuator 16, there is provided a pressure compensation valve 18, respectively. And they are constructed in such a manner that the said pressure compensation valve 18 may be thrusted towards a low pressure setting side under a pressure effective at a first pressure receiving portion 19 and may be thrusted towards a high pressure setting side under a pressure effective at a second pressure receiving portion 20. The first pressure receiving portion 19 is connected to an outlet side of each directional control valve 15 so as to be applied with an outlet side pressure that is effective therein, whereas the second pressure receiving portion 20 is connected to the respective circuit 17 via a shuttle valve 21 so as to be applied with the highest load pressure that is effective therein.

The above mentioned switching valve 14 is thrusted in the direction of communication under a pressure effective within the discharge path 10*a* and is thrusted in the direction of drain both by a spring 22 and under the above mentioned load pressure. When the discharge pressure P1 becomes higher than a force applied by the spring 22, the switching valve 14 will be shifted to apply the discharge pressure to the pressure receiving chamber 12*a* of the large diameter piston 12, thereby inclining the swash plate 11 in the displacement decreasing direction. When the discharge pressure P1 becomes lower than the force applied by the spring 22, the switching valve 14 will be returned to its original position to cause the the pressurized fluid in pressure receiving chamber 12*a* of the large diameter piston 12 to flow out into the tank side, thereby inclining the swash plate 11 in the displacement increasing direction.

A circuit 23 for applying the above mentioned load pressure to the pressure receiving portion 14*a* of the switching valve 14, that is, the circuit 23 for connecting the pressure receiving portion 14*a* to the output side of the shuttle valve 21, is connected to a tank 25 via a restrictor 24.

With such a pressurized fluid supply apparatus, if each directional control valve 15 is switched from its neutral position a to a supply position b, the pressurized discharge fluid from the hydraulic pump 10 will be supplied to the hydraulic actuators 16 while their higher load pressure will be detected at the shuttle valve 21 to act on the second pressure receiving portions 20 of the pressure compensation valves 18, respectively. Since each pressure compensation valve 18 is then set under the highest load pressure, the pressurized discharge fluid from the hydraulic pump 10 can be supplied to a plurality of the hydraulic actuators which are of different loads.

In such a pressurized fluid supply apparatus, an arrangement is adopted such that the highest load pressure detected at the shuttle valve 21 may act on the pressure receiving portion 14*a* of the switching valve 14 to operate the switching valve 14, thereby so controlling the displacement of the hydraulic pump 10 that a pressure difference between the pump discharge pressure P1 and the load pressure $P_{LS}$ can be maintained constant at all times.

This being the case, the flow supplied to a said hydraulic actuator 16 is determined by the meter-in opening area of a said directional control valve 15 associated therewith. If a large volumetric flow is supplied into a particular actuator 16, for example, a boom cylinder or an arm cylinder in a power shovel, it is necessary that a particular directional control valve associated therewith be large-sized to enlarge the meter-in opening area thereof, or that the above mentioned pressure difference between the pump discharge pressure P1 and the load pressure $P_{LS}$ be made larger.

However, if such a directional control valve 15 is large-sized, it ought to become different in size from another directional control valve 15 and this is disadvantageous in that they cannot be commonly used and it will necessarily increase their overall cost.

Also, in the pressurized fluid supply apparatus, the pressure loss due to the return flow that is flushed out of a said actuator 16 into a tank is determined by the meter-out opening area of the associated directional control valve. Hence, if a large volumetric flow is flushed out into the tank from a particular actuator 16, for example, a boom cylinder or an arm cylinder in a power shovel, the directional control valve associated therewith should be large-sized to enlarge the meter-out opening area, thereby reducing the pressure loss.

Especially, if the boom cylinder or the arm cylinder is contractively operated, the pressurized fluid is supplied into the contracting chamber of the cylinder, and the pressurized fluid within the elongating chamber is flushed out into the tank. Then, since the area of the elongating chamber of the cylinder is larger than that of its contracting chamber and the volumetric flow flushed out of the elongating chamber into the tank is more than the volumetric flow supplied into the contracting chamber, it is necessary that a large volumetric flow be flushed out of the elongating chamber into the tank in order for the boom cylinder or the arm cylinder to be contractively operated quickly.

However, if the said directional control valve 15 is large-sized, it becomes different in size from another directional control valve 15 to the disadvantage that they cannot be commonly used and an increased overall cost does result.

SUMMARY OF THE INVENTION

Accordingly, it is an object of the present invention to provide a flow control apparatus for use in a hydraulic circuit, whereby the problems mentioned above are resolved.

Another object of the present invention is to provide a flow control apparatus in a hydraulic circuit, which apparatus eliminates the need for the large-sizing of a directional control valve and the need for an elevated pump discharge pressure, and which is capable of supplying an operating fluid in a large volumetric flow into a hydraulic load such as a hydraulic actuator.

Still another object of the present invention is to provide a flow control apparatus in a hydraulic circuit, which is capable of returning an operating fluid in a large volumetric flow from a hydraulic load such as a hydraulic actuator to a pressurized fluid source, without large-sizing a directional control valve.

In order to achieve the foregoing objects, there is provided, in accordance with the present invention, in a first construction thereof, a pressurized fluid flow control apparatus in a hydraulic circuit in which a hydraulic pump has a discharge path that is provided with a plurality of directional control valves in parallel to one another, each of whose outlet sides is connected via a pressure compensation valve to a hydraulic actuator, respectively, and in which each of the pressure compensation valves is adapted to be set under a discharge pressure of the said pump and a maximum of load pressures of the hydraulic actuators, characterized in that the said discharge path of the hydraulic pump is provided with an auxiliary directional control valve whose outlet side is connected via a said pressure compensation valve to a particular one of the said hydraulic actuators that is in turn connected to a particular one of the said directional control valves.

The present invention also provides, in a second construction thereof, a flow control apparatus in a hydraulic circuit, in which a hydraulic pump has a discharge path that is provided with a plurality of pressure compensation valves in parallel to one another, each of whose outlet sides is provided with a directional control valve, respectively, to supply each of hydraulic actuators with a pressurized fluid, and in which each of the said pressure compensation valves is adapted to be set under a discharge pressure of the said pump and a load pressure of each of the said hydraulic actuators, characterized in that a particular one of the said pressure compensation valves is provided at an outlet side thereof with an auxiliary directional control valve in parallel to the said directional control valve and that the said auxiliary directional control valve has an outlet side which is connected to a particular one of the said hydraulic actuators that is in turn connected to the said directional control valve.

In connection withe above, it should be noted that in the first and the second construction of the present invention, a pilot valve can be provided for switching a particular directional control valve and the auxiliary directional control valve simultaneously.

The present invention also provides, in a third construction thereof, a flow control apparatus in a hydraulic circuit, in which a hydraulic pump has a discharge path that is provided with a plurality of directional control valves in parallel to one another, each of whose outlet sides is connected via a pressure compensation valve to a hydraulic actuator, respectively, and in which each of the pressure compensation valves is adapted to be set under a discharge pressure of the said pump and a maximum of load pressures of the hydraulic actuators, characterized in that a particular one of the said hydraulic actuators which is connected to a particular one of the said directional control valves is connected to an auxiliary directional control valve for flushing out a return fluid into a tank.

The present invention further provides, in a fourth construction thereof, a flow control apparatus in a hydraulic circuit, in which a hydraulic pump has a discharge path that is provided with a plurality of pressure compensation valves in parallel to one another, each of whose discharge sides is provided with a directional control valve, respectively, to supply each of hydraulic actuators with a pressurized fluid, and in which each of the said pressure compensation valves is adapted to be set under a discharge pressure of the said pump and a load pressure of each of the hydraulic actuators, characterized in that a particular one of the said hydraulic actuators which is connected to a particular one of the said directional control valves is connected to an auxiliary directional control valve for flushing out a return fluid into a tank.

In connection with the above, it should be noted that in the third and the fourth construction of the present invention, a pilot valve can be provided for switching a particular directional control valve and the auxiliary directional control valve simultaneously.

The present invention still further provides, in a fifth construction thereof, a flow control apparatus in a hydraulic circuit, characterized in that the apparatus comprises:

a first hydraulic load and a second hydraulic load;

a first high pressure side fluid passage for connecting a pressurized fluid source to the said first hydraulic load to apply a line pressure that is applied from the said pressurized fluid source to the said first hydraulic load;

a second high pressure side fluid passage for connecting the said pressurized fluid source to the said second hydraulic load to apply the line pressure that is applied from the said pressurized fluid source to the said second hydraulic load;

a first low pressure side fluid passage for connecting the said pressurized fluid source to the said first hydraulic load to return an operating fluid that is discharged from the said first hydraulic load to the said pressurized fluid source;

a second low pressure side fluid passage for connecting the said pressurized fluid source to the said second hydraulic load to return an operating fluid that is discharged from the said second hydraulic load to the said pressurized fluid source;

a flow adjustment passage interposed between the said pressurized fluid source and the said first hydraulic load; and valve means arranged in the said flow adjustment passage and able to shift at least between a first position for communicating at least the said pressurized fluid source with the said first hydraulic load and a second position for blocking a flow of the operating fluid between the said pressurized fluid source and the said first hydraulic load for adjusting at least one of a flow that is supplied to the said first hydraulic load and a flow that is returned from the said first hydraulic load to the said pressurized fluid source.

In connection with the above, it should be noted that the first and second high pressure side passages can be provided each with a directional control valve and a pressure compensation valve. Also, the above mentioned valve means in the said flow adjustment passage may be formed by an auxiliary directional control valve. Further, the above mentioned auxiliary directional control valve can be formed by a directional control valve of the type which may be driven by a pilot pressure, and can be so constructed that it may shift between the above mentioned first and second positions in accordance with a pilot pressure that is delivered from a pilot pressure supply circuit.

Also, the above mentioned pilot pressure supply circuit can be of a construction that includes a manually controllable pilot valve.

In the above mentioned fifth construction of the present invention, it is preferable that the said pressure compensation valve that can be provided in either of the said first and second high pressure side passages be so constructed that it may be set in accordance with the discharge pressure of the above mentioned pressurized fluid source and the respective load pressures of the above mentioned first and second hydraulic loads. Also, the outlet side of each pressure compensation valve as mentioned above is preferably connected to the above mentioned directional control valve, and so is the above mentioned flow adjustment passage that can be connected to the outlet side of the above mentioned first high pressure side fluid passage in parallel to the above mentioned directional control valve and can also be connected to the inlet of the above mentioned first hydraulic load. Furthermore, the above mentioned flow adjustment passage can be connected with a portion between the above mentioned pressurized fluid source and the outlet of the above mentioned first hydraulic load in parallel to the above mentioned low pressure side passage. Moreover, the above mentioned pressure compensation valve that may be provided in either of the said first and second high pressure side passages can be connected to the outlet side of the directional control valve, and can be so constructed that it may be set in accordance with the discharge pressure of the above mentioned pressurized fluid source and the maximum of load pressures of the said first and second hydraulic loads. In addition, the above mentioned flow adjustment passage can be connected with a portion between the above mentioned pressurized fluid source and the outlet of the above mentioned first hydraulic load in parallel to the above mentioned first low pressure side passage.

BRIEF EXPLANATION OF THE DRAWINGS

The present invention will better be understood from the following detailed description and the drawings attached hereto showing certain illustrative embodiments of the present invention. In this connection, it should be noted that such embodiments as illustrated in the accompanying drawings are intended in no way to limit the present invention, but to facilitate an explanation and understanding thereof.

In the accompanying drawings.

BEST MODES FOR CARRYING OUT THE INVENTION

Figure 1:
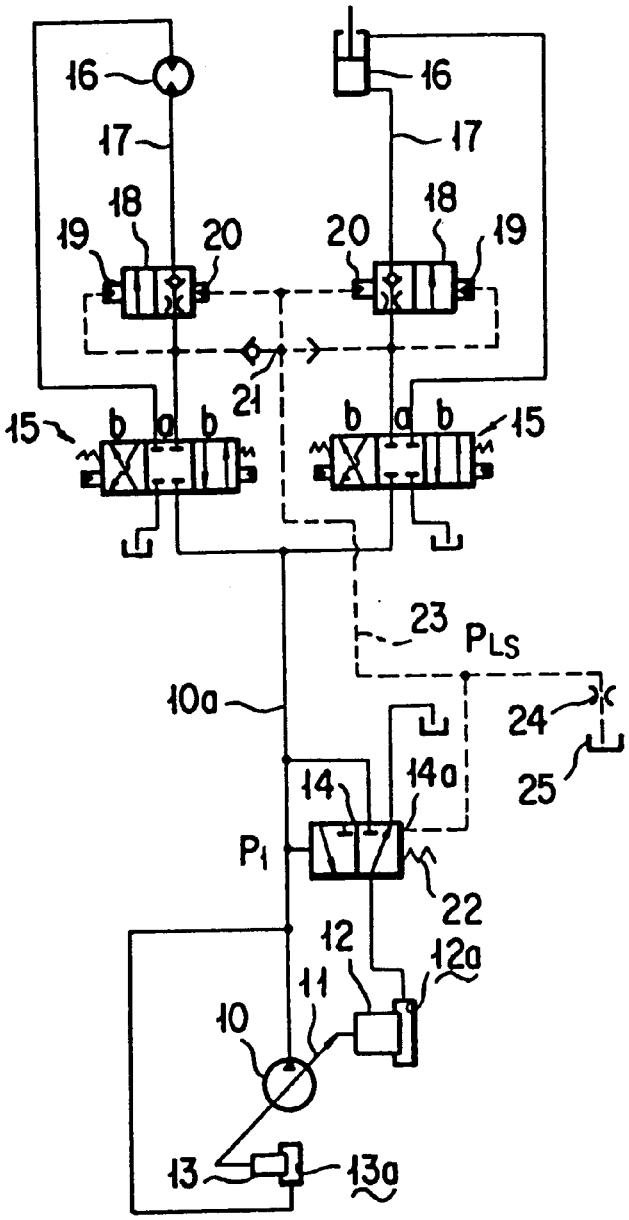
FIG. 1 is a diagrammatic view illustrating a conventional flow control apparatus in a hydraulic circuit.

Hereinafter, suitable embodiments of the present invention will be set out, first with reference to FIGS. 2 to 6. In the following explanation, it should be noted that the details of various elements involved in these embodiments will be set out in order to aid in gaining a complete understanding of the present invention. It will be obvious to a person skilled in the art, however, that the present invention can be practiced without using such detailedly explained constructions. Moreover, the detailed explanation that relates to a known construction is omitted in order not to make a construction of the present invention unnecessarily vague. Also, the same members in the prior art are designated by the same reference numerals, respectively. Further, for the sake of simplifying the explanation, a pressure compensation valve 18 is shown in association with one of the circuits 17 and its showing in association with another circuit 17 is omitted.

Figure 2:
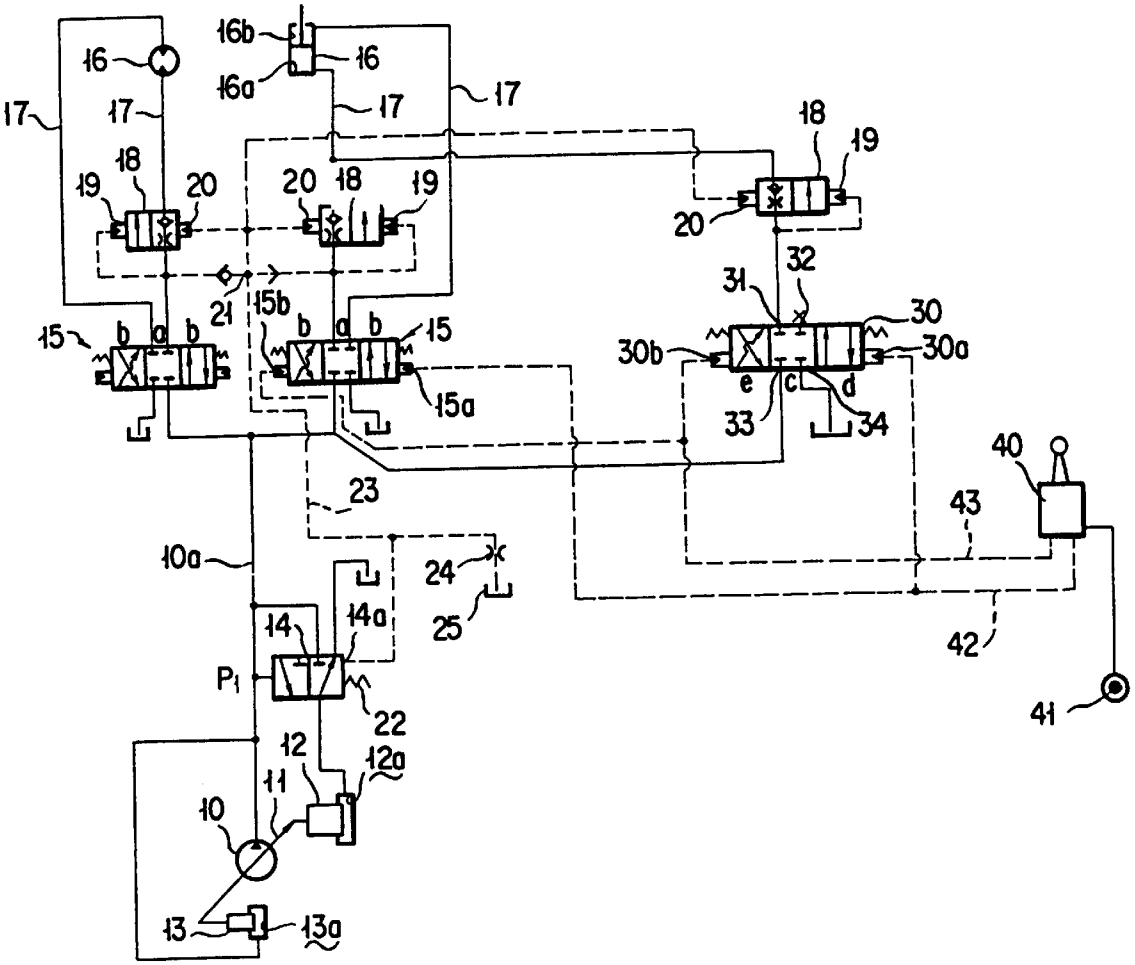
FIG. 2 is a hydraulic system diagram illustrating a first embodiment of the flow control apparatus in a hydraulic circuit according to the present invention.

As shown in FIG. 2, the discharge path 10*a* from the hydraulic pump 10 is provided with an auxiliary directional control valve 30. A first actuator port 31 of the auxiliary directional control valve 30 is connected via the pressure compensation valve 18 to the circuit 17 of one of the hydraulic actuators 16.

The auxiliary directional control valve 30 includes, besides the first actuator port 31, a second actuator port 32, a pump port 33 and a tank port 34. The auxiliary directional control valve 30 is adapted to be switched over among a neutral position c in which each of these ports is blocked, a first position d for communicating the pump port 33 with the first actuator port 31 and communicating the second actuator port 32 with the tank port 34, and a second position e for communicating the pump port 33 with the second actuator port 32 and communicating the first actuator port 31 with the tank port 34.

There is also provided a pilot valve 40 for supplying the pressurized discharge fluid from a pilot purpose hydraulic pump 41 into a first pilot circuit 42 and a second pilot circuit 43. The first pilot circuit 42 is connected to a first pressure receiving portion 30*a* of the auxiliary directional control valve 30 and to the first pressure receiving portion 15*a* of a first one (at the right hand side) of the directional control valves 15. The second pilot circuit 43 is connected to a second pressure receiving portion 30*b* of the auxiliary directional control valve 30 and to the second pressure receiving portion 15*b* of the first one (at the right hand side) of the directional control valves 15.

If a pressurized pilot fluid is supplied by the pilot valve 40 into the first pilot circuit 42, the first directional control valve 15 will be forced to take the supply position b located at a right hand side whereas the auxiliary control valve 30 will be forced to take the first position d. Therefore, the pressurized discharge fluid from the hydraulic pump 10 will be supplied to a first one (at the right hand side) of the hydraulic actuators 16 via the first directional control valve 15 and the auxiliary directional control valve 30 whereas its return fluid will be flushed via the first directional control valve 15 into a tank.

Accordingly, the flow that is supplied into the elongating chamber 16*a* of the first hydraulic actuator 16 will become to be proportional to the sum of the meter-in opening area of the first directional control valve 15 and that of the auxiliary directional control valve 30, and thus can be a large volumetric flow that may be supplied.

When the pressurized pilot fluid is supplied by the pilot valve 40 into the second pilot circuit 43, the first directional control valve 15 will be forced to take the supply position b located at a left hand side whereas the auxiliary directional control valve 30 will be forced to take the second position e. When the auxiliary directional control valve 30 takes the position e, the pump port 33 will be communicated with the second actuator port 32 so as not to supply the circuit 17 with the pressurized fluid. Therefore, the pressurized fluid will then be supplied into one (at the right hand side) of the hydraulic actuators 16 only via the first directional control valve 15 and thus should be a small volumetric flow that can be supplied into the contracting chamber 16*b*.

Figure 3:
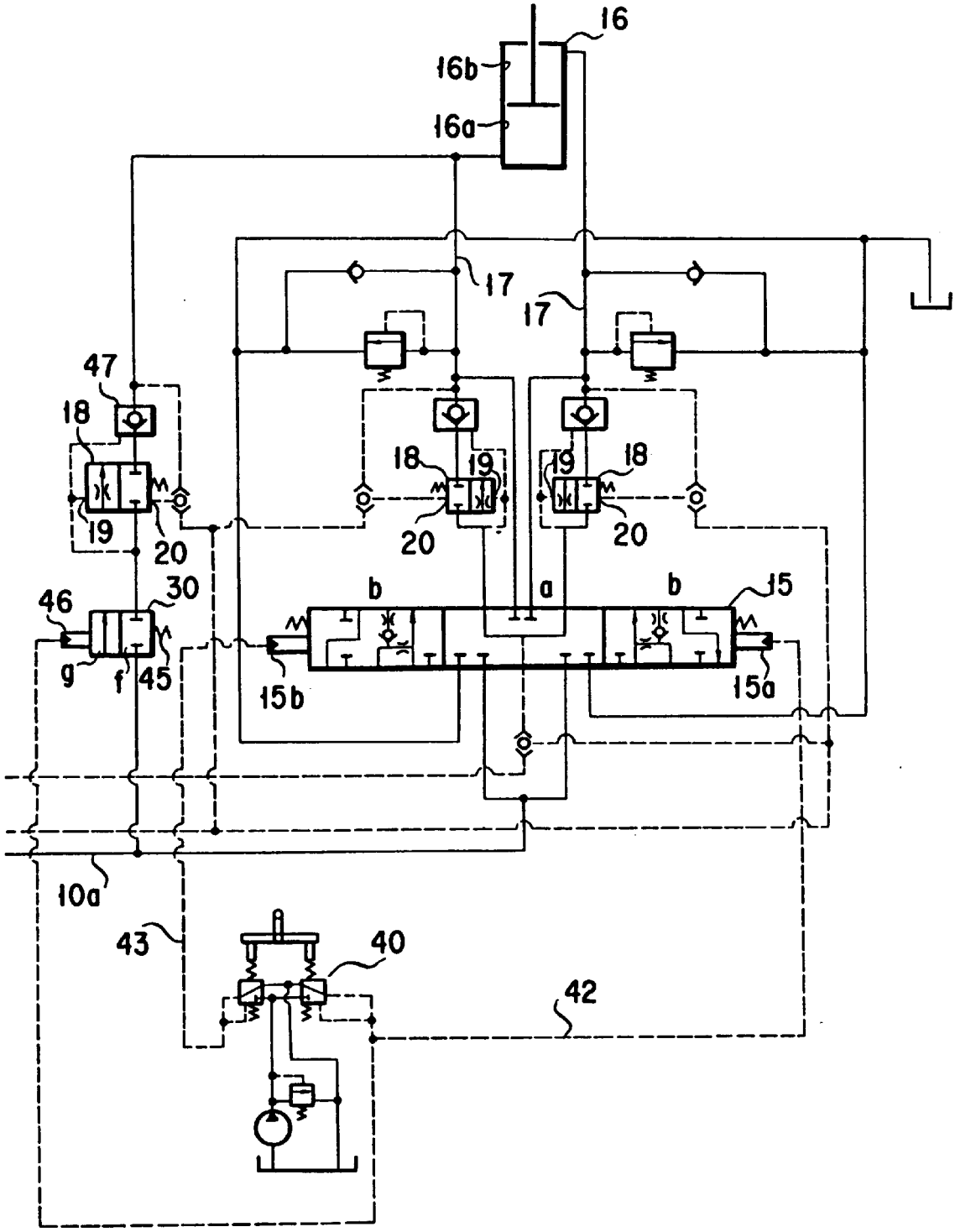
FIG. 3 is a hydraulic system diagram illustrating a second embodiment of the flow control apparatus in a hydraulic circuit according to the present invention.

FIG. 3 shows a second embodiment of the flow control apparatus in a hydraulic circuit according to the present invention. In this embodiment, the hydraulic actuator 16 is assumed to be a boom cylinder of a power shovel. The auxiliary directional control valve 30 is held to take a blocking position f by means of a spring 45 and is constructed to take a position of communication g under a pressure that is effective at a pressure receiving portion 46. The pressure receiving portion 46 of the auxiliary directional control valve 30 is connected to the first pilot circuit 42, and the pressure compensation valve 18 is provided at its output side with a check valve 47.

With the apparatus so constructed, since a large volumetric flow can be supplied into the elongating chamber 16*a* of the first hydraulic actuator 16, it follows, for example, that the boom cylinder or arm cylinder in a power shovel can be operated quickly under an elevated pressure, thus giving rise to an advantage at the time of arm excavation on a boom.

Figure 4:
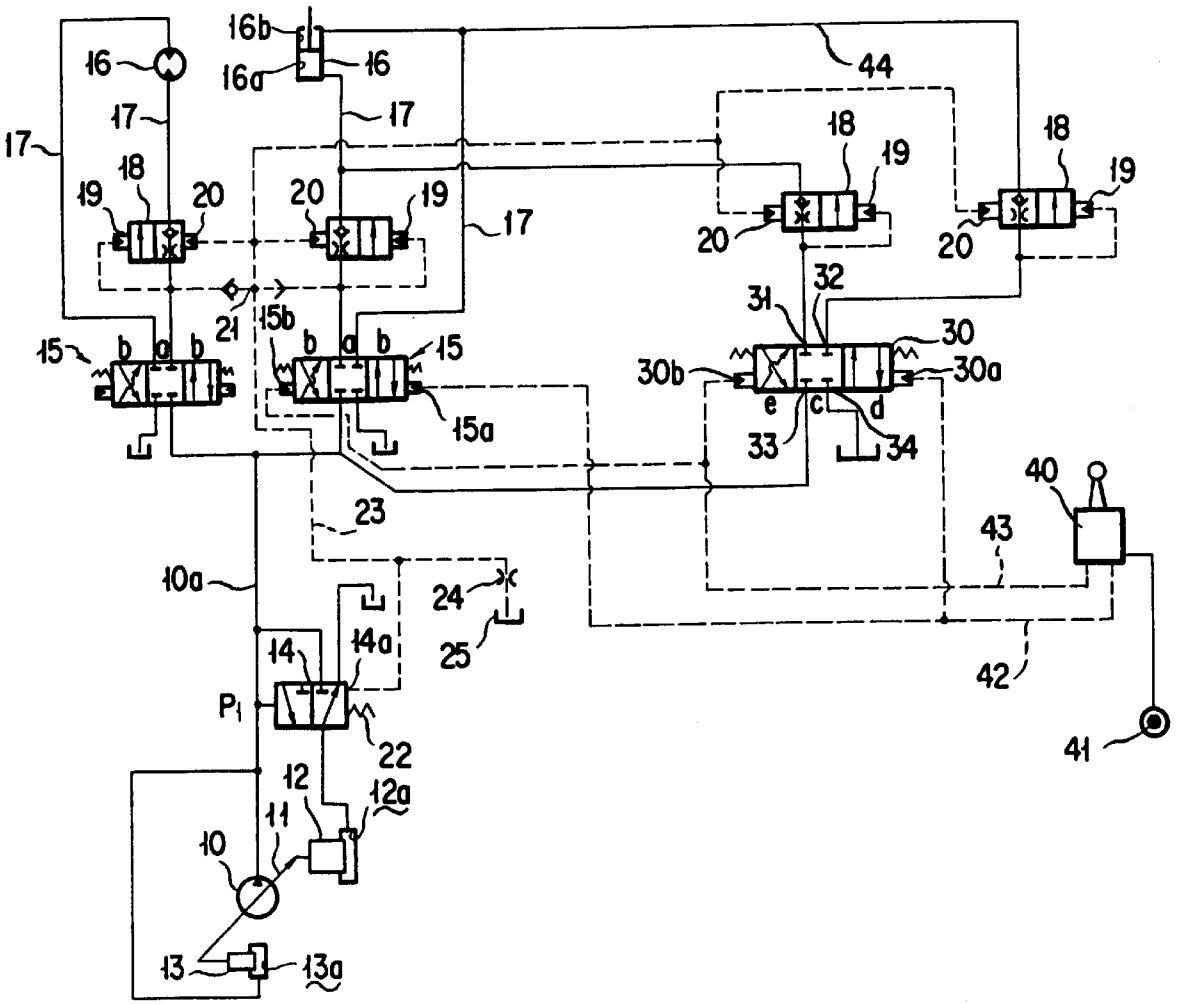
FIG. 4 is a hydraulic system diagram illustrating a third embodiment of the flow control apparatus in a hydraulic circuit according to the present invention.

FIG. 4 shows a third embodiment of the flow control apparatus in a hydraulic circuit according to the present invention. In this embodiment, the second actuator port 32 of the auxiliary directional control valve 30 is connected via a circuit 44 to the contracting chamber 16*b* of the first hydraulic actuator 16.

This being the case, the pressurized fluid can be supplied via the auxiliary directional control valve 30 into the contracting chamber 16*b* of the one of the hydraulic actuators 16 in a manner as mentioned before.

Figure 5:
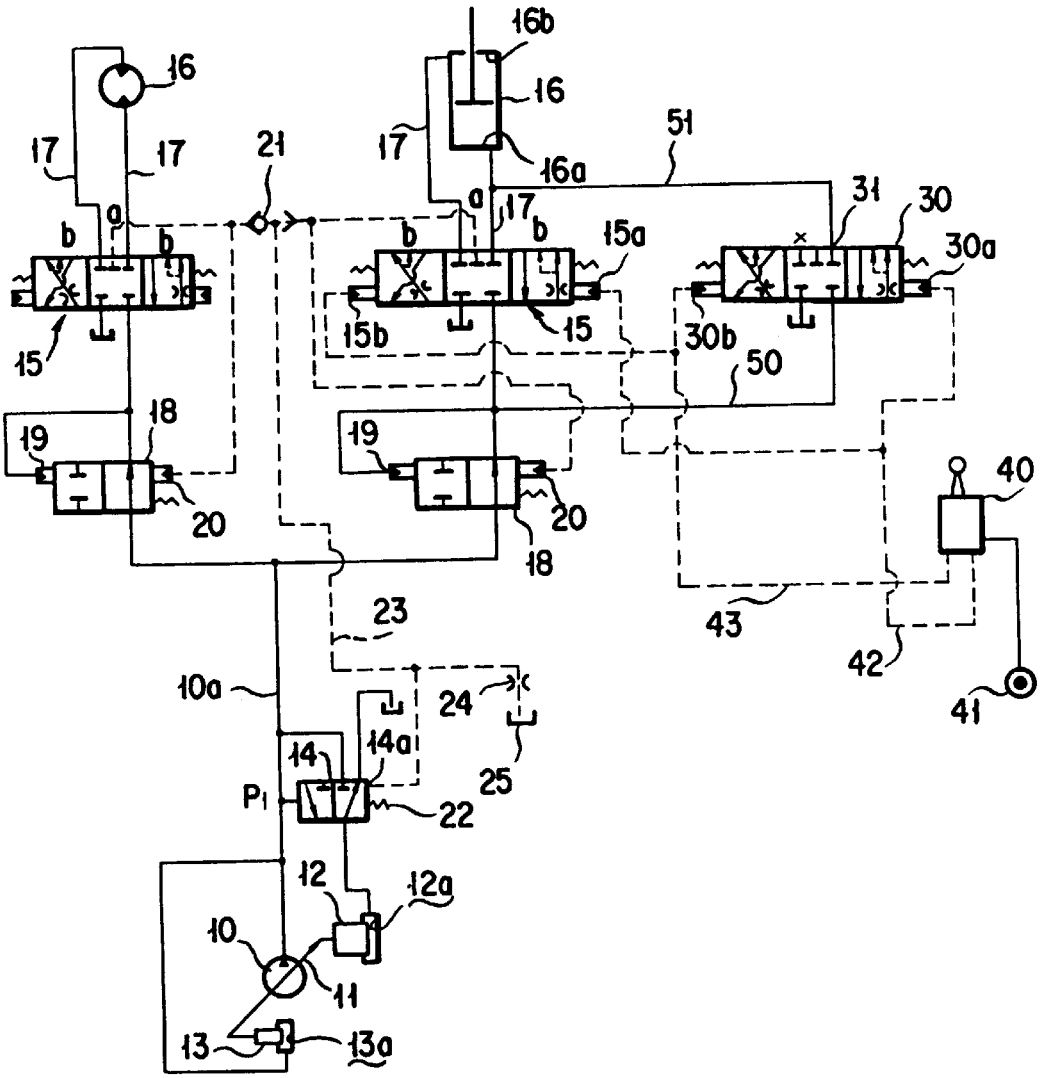
FIG. 5 is a hydraulic system diagram illustrating a fourth embodiment of the flow control apparatus in a hydraulic circuit according to the present invention.
Figure 6:
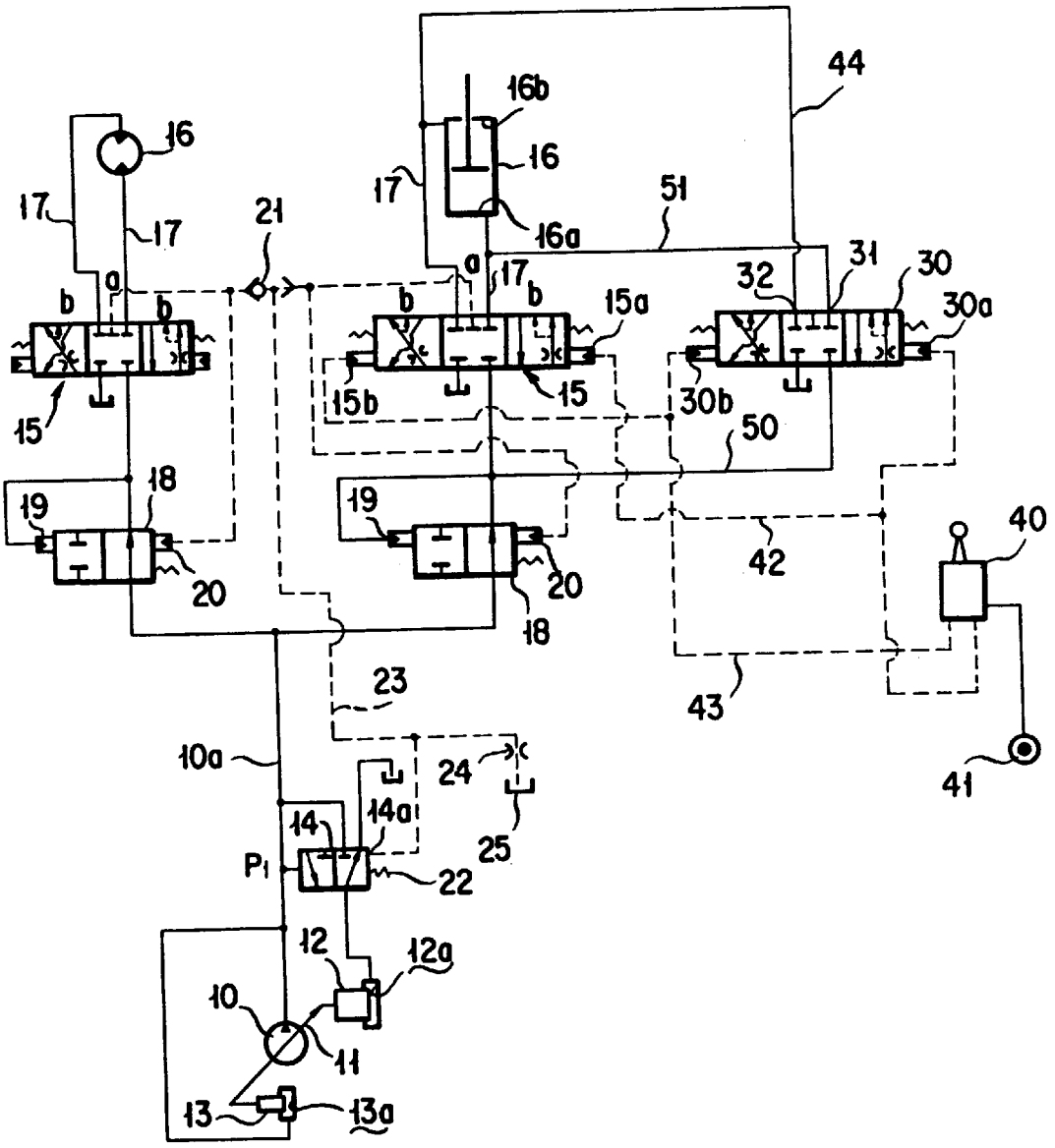
FIG. 6 is a hydraulic system diagram illustrating a fifth embodiment of the flow control apparatus in a hydraulic circuit according to the present invention.

While in each of the specific embodiments mentioned before, a pressure compensation valve 18 is provided between a directional control valve 15 and a hydraulic actuator 16, the pressure compensation valve 18 may be provided between the hydraulic pump 10 and a directional control valve 15 as shown in FIGS. 5 and 6.

More specifically, as shown in FIG. 5, the outlet side of a pressure compensation valve may be branched with a circuit 50, which can be provided with the auxiliary directional control valve 30, of which the first actuator port 31 can, in turn, be connected to the circuit 17 via a circuit 51.

Also, as shown in FIG. 6, the second actuator port 32 of the auxiliary directional control valve 30 may be connected via the circuit 44 to the contracting chamber 16*b* of the hydraulic actuator 16.

In supplying a pressurized fluid from a particular one of the directional control valves 15 to a particular one of the hydraulic actuators 16, the pressurized fluid can be supplied into that particular hydraulic actuator 16 via the auxiliary directional control valve 30.

Therefore, since a large volumetric flow can be supplied to a particular hydraulic actuator 16 and a particular directional control valve 15 can be made identical in seize to another directional control valve 15 to the extent that they can be commonly used, a reduced overall cost will ensue. Yet, since the pressure difference between the pump discharge pressure and the load pressure needs not to be made large, a reduced loss in the driving force of a hydraulic motor ensues.

Figure 7:
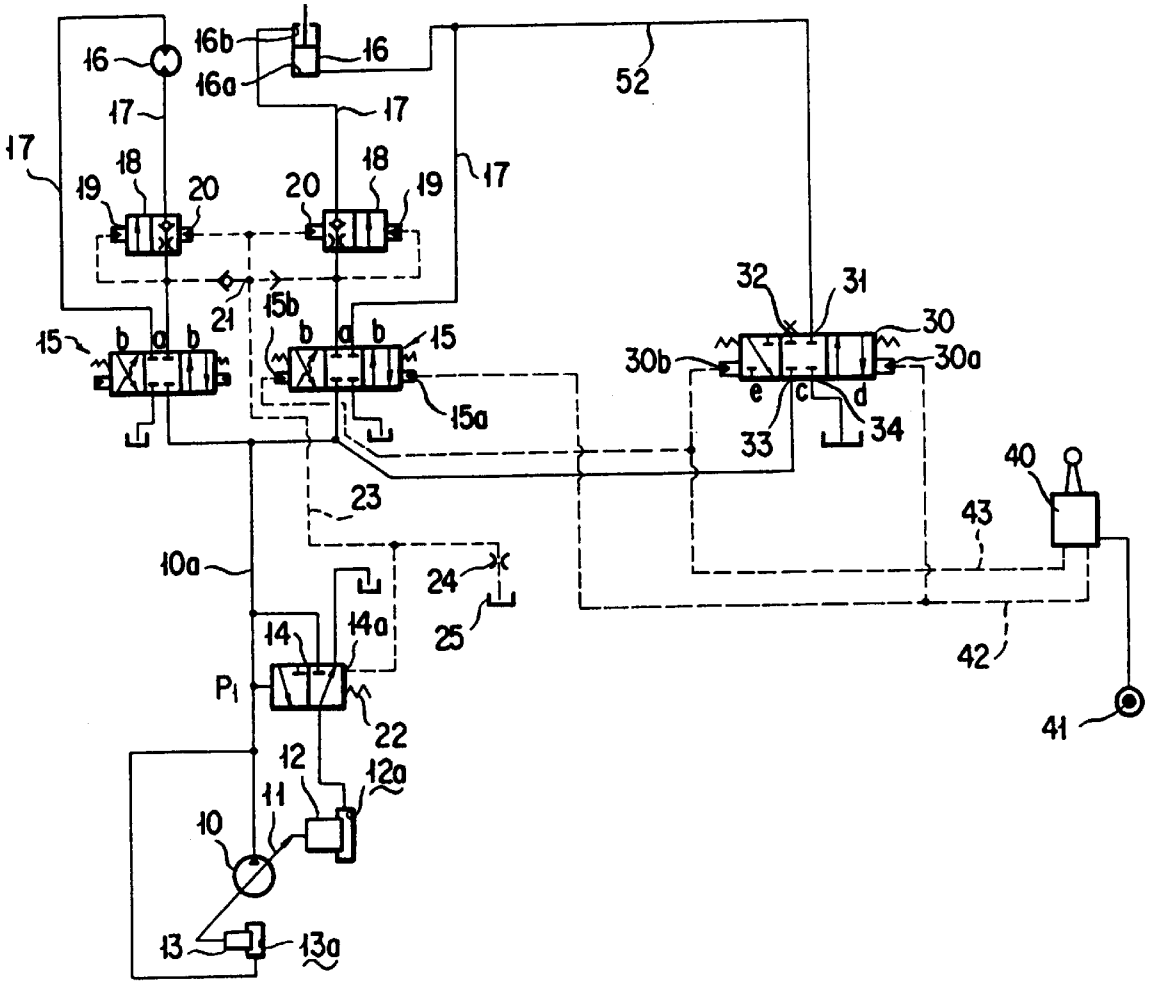
FIG. 7 is a hydraulic system diagram illustrating a sixth embodiment of the flow control apparatus in a hydraulic circuit according to the present invention.

FIG. 7 shows a sixth embodiment of the flow control apparatus in a hydraulic circuit according to the present invention. The construction of this embodiment represents a slight variation from the construction shown in FIG. 2, in which in returning a pressurized fluid from a hydraulic actuator into a reservoir tank, the pressurized fluid can be of a large volumetric flow that may be returned. The discharge path 10*a* from the hydraulic pump 10 is here provided with the auxiliary directional control valve 30 as in the first embodiment of the invention. This auxiliary directional control valve 30 is so constructed that its first actuator port 31 may be connected via a circuit 52 to the elongating chamber 16*a* of one of the hydraulic actuators 16. As in the first embodiment set forth before, the auxiliary directional control valve 30 has a first actuator port 31, a second actuator port 32, a pump port 33 and a tank port 34, and is adapted to be switched over among a neutral position c in which each of these ports is blocked, a first position d for communicating the pump port 33 with the second actuator port 32 and communicating the first actuator port 31 with the tank port 34, and a second position e for blocking a communication between the pump port 33 and the first actuator port 31 and communicating the second actuator port 32 with the tank port 34. Also, the pilot valve 40 is designed to supply a pressurized discharge fluid from a pilot purpose hydraulic pump 41 into a first pilot circuit 42 and a second pilot circuit 43. The first pilot circuit 42 is connected to the first pressure receiving portion 30*a* of the above mentioned auxiliary directional control valve 30 and to the first pressure receiving portion 15*a* of a first one (at the right hand side) of the directional control valves 15, whereas the second pilot circuit 43 is connected to the second pressure receiving portion 30*b* of the auxiliary directional control valve 30 and to the second pressure receiving portion 15*b* of the first one (at the right hand side) of the directional control valves 15.

When a pressurized pilot fluid is supplied by the pilot valve 40 into the first pilot circuit 42, the first directional control valve 15 will be forced to take the supply position b located at its right hand side whereas the auxiliary directional control valve 30 will be forced to take the first position d. Then, the pressurized discharge fluid from the hydraulic pump 10 will be supplied into the contracting chamber 16*b* of the first one (at the right hand side) of the hydraulic actuator 16, and the return fluid out of the elongating chamber 16*a* will be flushed via the one directional control valve 15 and the auxiliary directional control valve 30 into the tank.

Therefore, since the return flow is returned proportionally to the sum of the meter-out opening area of the first directional control valve 15 and that of the auxiliary directional control valve 30, a reduced pressure loss will result and the loss due to the return flow will be reduced.

When the pressurized pilot fluid is supplied by the pilot valve 40 into the second pilot circuit 43, the first directional control valve 15 will be forced to take the supply position b located at its left hand side whereas the auxiliary directional control valve 30 will be forced to take the second position e. When the auxiliary directional control valve 30 takes the position e, the communication between the first actuator port 31 and the tank port 34 will be blocked. Accordingly, the pressurized fluid out of the contracting chamber 16*b* of the one (at the right hand side) of the hydraulic actuators 16 will be flushed into the tank only via the one of the directional control valves 15.

Since a large volumetric flow can be flushed out of the elongating chamber 16*a* of the first hydraulic actuator 16 into the tank of a low pressure loss in this manner, it follows, for example, that an arm cylinder in a power shovel can be contractively operated quickly, thus giving rise to an advantage at the time of damping.

Figure 8:
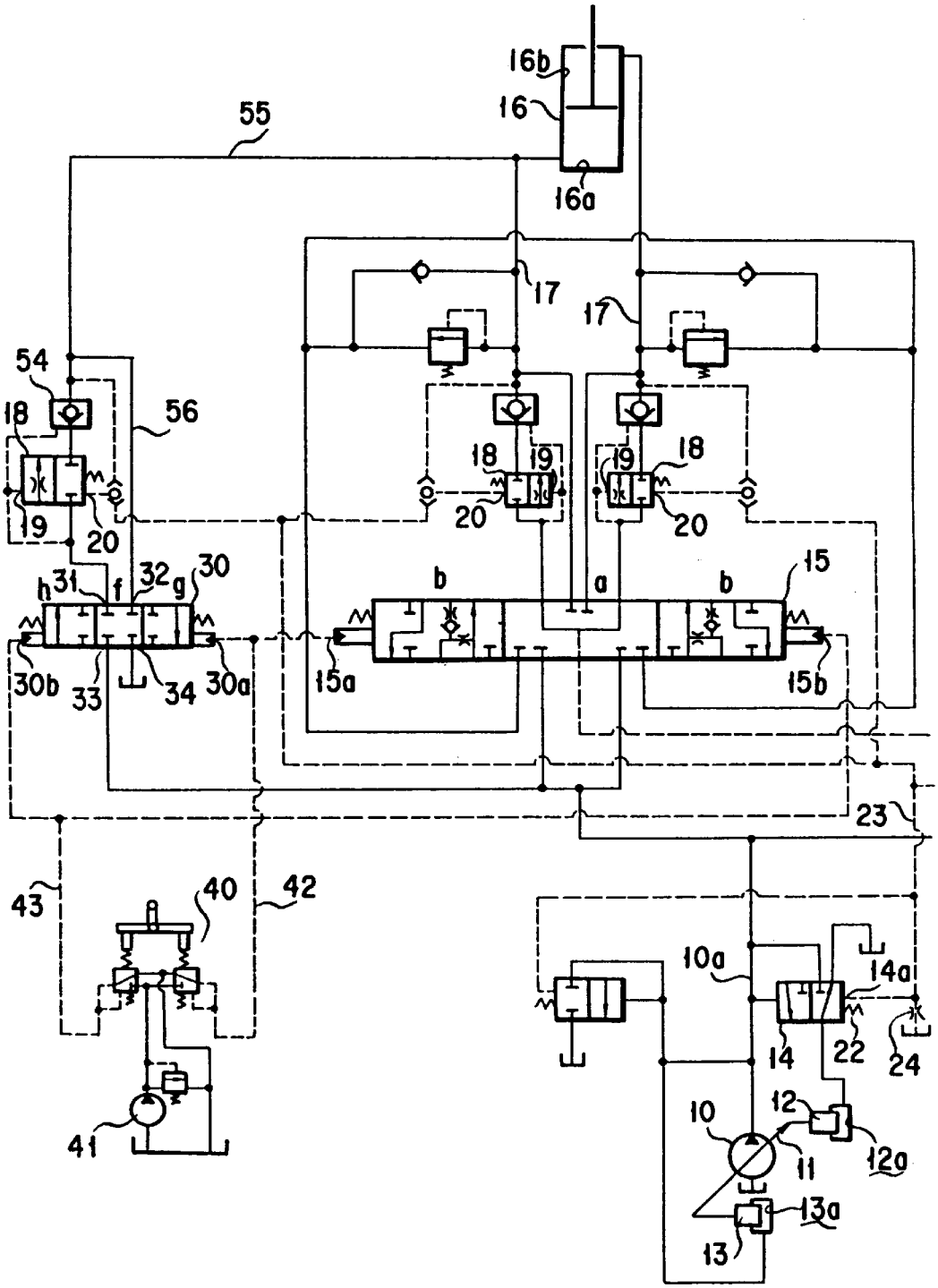
FIG. 8 is a hydraulic system diagram illustrating a seventh embodiment of the flow control apparatus in a hydraulic circuit according to the present invention.

FIG. 8 shows a seventh embodiment of the flow control apparatus in a hydraulic circuit according to the present invention. This embodiment represents a slight variation of the embodiment of FIG. 3, in which in returning a pressurized fluid from the hydraulic actuator into the reservoir tank in a hydraulic circuit, the pressurized fluid can be of a large volumetric flow that may be returned. In this embodiment, the hydraulic actuator 16 is constituted by an arm cylinder of a power shovel, and the auxiliary directional control valve 30, which has a pump port 33, a first actuator port 31, a second actuator port 32 and a tank port 34, can be held to take a neutral position f in which each of these ports is blocked by means of a spring force, and can be switched to take a first position g for establishing a communication between the second actuator port 32 and the tank port 34 and blocking a communication between the pump port 33 and the first actuator port 31 under a pressure effective at the first pressure receiving portion 30*a*, and to take a second position h for establishing a communication between the pump port 33 and the first actuator port 31 and a communication between the second actuator port 32 and the tank port 34 under a pressure effective at the second pressure receiving portion 30*b*.

The above mentioned first actuator port 31 is connected via the pressure compensation valve 18 and the check valve 54 and through a circuit 55 to the elongating chamber 16*a* of the hydraulic actuator 16, whereas the second actuator port 32 is connected through a circuit 56 and via the check valve 54 in the circuit 55 to their upstream side.

In the construction mentioned above, when the directional control valve 15 takes the supply position b located at its right hand side to supply the pressurized fluid into the elongating chamber 16*a* of the hydraulic actuator 16, the auxiliary directional control valve 30 can be forced to take its second position h to supply the pressurized Tfluid via the pressure compensation valve 18 into the elongating chamber 16*a* of the hydraulic actuator 16. And, when the directional control valve 15 takes the supply position b located at its left hand side to supply the pressurized fluid into the contracting chamber 16*b* of the hydraulic actuator 16, the auxiliary directional control valve 30 will be forced to take its first position to permit the pressurized fluid within the elongating chamber 16*a* of the hydraulic actuator 16 to flow out into the tank.

Figure 9:
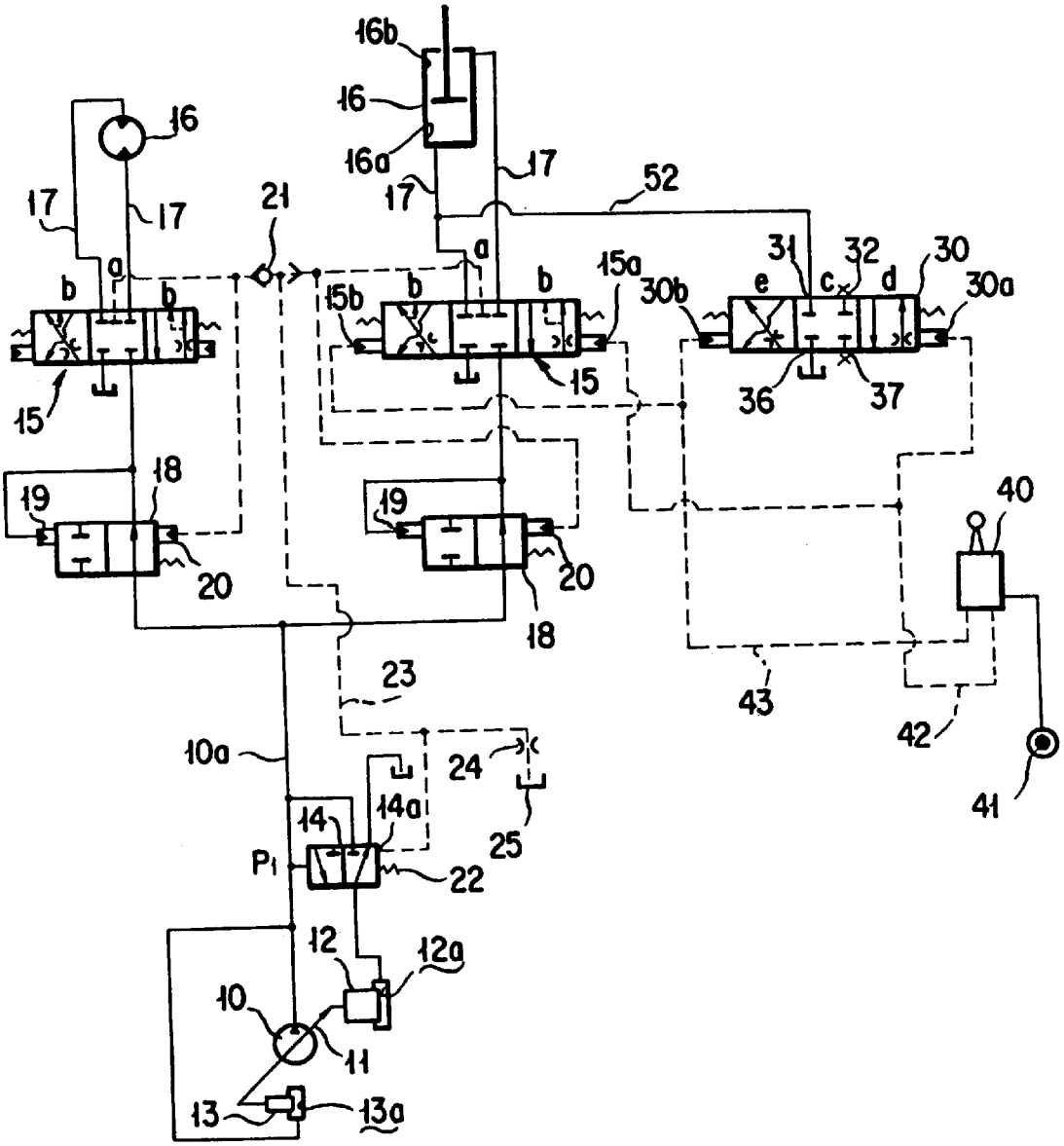
FIG. 9 is a hydraulic system diagram illustrating an eighth embodiment of the flow control apparatus in a hydraulic circuit according to the present invention.

While in the various embodiments set forth above, a pressure compensation valve 18 is provided between the directional control valve 15 and the hydraulic actuator 16, the pressure compensation valve may alternatively be arranged between the hydraulic pump 10and the directional control valve 15 as shown in FIG. 9. In this case, the auxiliary directional control valve 30 has a first actuator port 31 and a second actuator port 32 as well as a first tank port 36 and a second tank port 37 and, when taking its first position d, is arranged to communicate the first actuator port 31 with the first tank port 36.

When the pressurized fluid is supplied from a particular directional control valve 15 to a particular hydraulic actuator 16, its return fluid of that particular hydraulic actuator 16 can be flushed from the auxiliary directional control valve 30 into the tank. Therefore, since in flushing a large volumetric flow out of the particular hydraulic actuator 16 into the tank, the pressure loss can then be reduced, a particular directional control valve 15 can be made identical in seize to another directional control valve 15 to the extent that they can be commonly used, a reduced overall cost associated therewith will ensue.

While the present invention has hereinbefore been described with respect to certain illustrative embodiments thereof, it will readily be appreciated by a person skilled in the art to be obvious that many alterations thereof, omissions therefrom and additions thereto can be made without departing from the essence and the scope of the present invention. Accordingly, it should be understood that the present invention is not limited to the specific embodiments thereof set out above, but includes all possible embodiments thereof that can be made within the scope with respect to the features specifically set forth in the appended claims and encompasses all equivalents thereof.

What is claimed is:

1. A pressurized fluid flow control apparatus in a hydraulic circuit in which a hydraulic pump has a discharge path that is provided with a plurality of directional control valves in parallel to one another, each of whose outlet side is connected via a pressure compensation valve to a hydraulic actuator, respectively, and in which each of the pressure compensation valves is adapted to be set under a discharge pressure of said pump and a maximum of load pressures of the hydraulic actuators, characterized in that said discharge path of the hydraulic pump is provided with an auxiliary directional control valve whose outlet side is connected via another pressure compensation valve to one of said hydraulic actuators that is in turn connected to a particular one of said directional control valves, and said another pressure compensation valve is adapted to be set under the discharged pressure of said pump and the maximum of load pressures of the hydraulic actuators.

2. A flow control apparatus in a hydraulic circuit, as set forth in claim 1, in which there is provided a pilot valve for switching said particular directional control valve and said auxiliary directional control valve simultaneously.

3. A flow control apparatus in a hydraulic circuit, in which a hydraulic pump has a discharge path that is provided with a plurality of directional control valves in parallel to one another, each of whose outlet sides is connected via a pressure compensation valve to a hydraulic actuator, respectively, and in which each of the pressure compensation valves is adapted to be set under a discharge pressure of said pump and a maximum of load pressures of the hydraulic actuators, characterized in that a particular one of said hydraulic actuators which is connected to a particular one of said directional control valves is connected to an auxiliary directional control valve for flushing out a return fluid into a tank.

4. A flow control apparatus in a hydraulic actuator, as set forth in claim 3, in which there is provided a pilot valve for switching said particular directional control valve and said auxiliary directional control valve simultaneously.

5. A flow control apparatus in a hydraulic circuit, characterized in that the apparatus comprises:

a pressurized fluid source;

a first hydraulic load and a second hydraulic load;

a first high pressure side fluid passage for connecting said pressurized fluid source to said first hydraulic load to apply a line pressure that is applied from said pressurized fluid source to said first hydraulic load;

a second high pressure side fluid passage for connecting said pressurized fluid source to said second hydraulic load to apply the line pressure that is applied from said pressurized source to said second hydraulic load;

a first low pressure side fluid passage for connecting said pressurized fluid source to said first hydraulic load to return an operating fluid that is discharged from said first hydraulic load to said pressurized fluid source;

a second low pressure side fluid passage for connecting said pressurized fluid source to said second hydraulic load to return an operating fluid that is discharged from said second hydraulic load to said pressurized fluid source;

a flow adjustment passage interposed between said pressurized fluid source and said first hydraulic load; and valve means arranged in said flow adjustment passage and able to shift at least between a first position for communicating at least said pressurized fluid source with said first hydraulic load and a second position for blocking a flow of the operating fluid between said pressurized fluid source and said first hydraulic load for adjusting at least one of a flow that is supplied to said first hydraulic load and a flow that is returned from said first hydraulic load to said pressurized fluid source.

6. A flow control apparatus as set forth in claim 5, in which said first and second high pressure side passages can be provided each with a directional control valve and a pressure compensation valve.

7. A flow control apparatus as set forth in claim 5, in which said flow adjustment passage is formed by an auxiliary directional control valve.

8. A flow control apparatus as set forth in claim 7, in which said auxiliary directional control valve is formed by a directional control valve of the type that can be driven by a pilot pressure, and is so constructed that it may shift between said first and second positions in accordance with a pilot pressure that is delivered from a pilot pressure supply circuit.

9. A flow control apparatus as set forth in claim 8, in which said pilot pressure supply circuit includes a manually controllable pilot valve.

10. A flow control apparatus as set forth in claim 5, in which said pressure compensation valve that is provided in either of said first and second high pressure side passages is so constructed that it may be set in accordance with the discharge pressure of said pressurized fluid source and the respective load pressures of said first and second hydraulic loads, and in which the outlet side of each pressure compensation valve as mentioned above is connected to said directional control valve, and said flow adjustment passage is connected to an outlet side of said pressure compensation valve of said first high pressure side fluid passage in parallel to said directional control valve and is also connected to an inlet of said hydraulic load.

11. A flow control apparatus as set forth in claim 5, in which said pressure compensation valve that is provided in either of said first and second high pressure side passages is so constructed that it may be set in accordance with the discharge pressure of said pressurized fluid source and the respective maximum load pressures of said first and second hydraulic loads, and in which the outlet side of each pressure compensation valve as mentioned above is connected to said directional control valve, and said flow adjustment passage is connected with a portion between an outlet of said first hydraulic load and said pressurized fluid source in parallel to said first low pressure side fluid passage.

12. A flow control apparatus as set forth in claim 6, in which said pressure compensation valve that is provided in either of said first and second high pressure side passages is connected to the outlet side of said directional control valve and is also so constructed that it may be set in accordance with the discharge pressure of said pressurized fluid source and the maximum of load pressures of said first and second hydraulic loads, and in which said flow adjustment passage is connected with a portion between an outlet of said first hydraulic load and said pressurized fluid source in parallel to said first low pressure side fluid passage.

13. A flow control apparatus in a hydraulic circuit, characterized in that the apparatus comprises:

a pressurized fluid source;

at least one hydraulic load;

a high pressure side fluid passage for connecting said pressurized fluid source to said hydraulic load to apply a line pressure that is applied from said pressurized fluid source to said hydraulic load;

a low pressure side fluid passage for connecting said pressurized fluid source to said hydraulic load to return an operating fluid that is discharged from said hydraulic load to said pressurized fluid source;

a flow adjustment passage interposed between said pressurized fluid source and said hydraulic load; and valve means arranged in said flow adjustment passage and able to shift at least between a first position for communicating at least said pressurized fluid source with said hydraulic load and a second position for blocking a flow of the operating fluid between said pressurized fluid source and said hydraulic load for adjusting at least one of a flow that is supplied to said hydraulic load and a flow that is returned from said hydraulic load to said pressurized fluid source.

14. A flow control apparatus as set forth in claim 13, in which said flow adjustment passage is formed by an auxiliary directional control valve.

15. A flow control apparatus as set forth in claim 14, in which said auxiliary directional control valve is formed by a directional control valve of the type that can be driven by a pilot pressure, and is so constructed that it may shift between said first and second positions in accordance with a pilot pressure that is delivered from a pilot pressure supply circuit.

16. A flow control apparatus as set forth in claim 15, in which said pilot pressure supply circuit includes a manually controllable pilot valve.

* * * * *